US009500368B2

(12) United States Patent
Ryan

(10) Patent No.: US 9,500,368 B2
(45) Date of Patent: Nov. 22, 2016

(54) ALTERNATELY SWIRLING MAINS IN LEAN PREMIXED GAS TURBINE COMBUSTORS

(75) Inventor: William R. Ryan, Oviedo, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 1797 days.

(21) Appl. No.: 12/235,866

(22) Filed: Sep. 23, 2008

(65) Prior Publication Data

US 2010/0071378 A1 Mar. 25, 2010

(51) Int. Cl.
*F23R 3/14* (2006.01)
*F23R 3/34* (2006.01)

(52) U.S. Cl.
CPC *F23R 3/14* (2013.01); *F23R 3/343* (2013.01)

(58) Field of Classification Search
CPC ..... F23R 3/14; F23R 3/343
USPC ..... 60/737, 746, 747, 748
See application file for complete search history.

(56) References Cited

U.S. PATENT DOCUMENTS 1,508,718 A 9/1924 Peabody
2,647,369 A * 8/1953 Leduc ..... 60/804
2,755,750 A 7/1956 Escher
3,834,159 A * 9/1974 Vdoviak ..... 60/746
4,173,118 A * 11/1979 Kawaguchi ..... 60/733
4,991,398 A 2/1991 Clark et al.
6,026,645 A 2/2000 Stokes et al.
6,068,467 A * 5/2000 Mandai et al. ..... 431/174
6,082,111 A 7/2000 Stokes
6,122,916 A 9/2000 Amos et al.
6,755,024 B1 6/2004 Mao et al.
6,931,853 B2 * 8/2005 Dawson ..... 60/725

FOREIGN PATENT DOCUMENTS

DE 102007004394 A1 10/2007
EP 0893650 A2 1/1999
EP 1193450 A1 4/2002

* cited by examiner

*Primary Examiner* — Carlos A Rivera

(57) ABSTRACT

A gas turbine combustor for producing hot gas by burning a fuel in compressed air comprising a combustor central axis and multiple main swirlers with respective swirler axes disposed about and parallel to the combustor central axis, each main swirler delivering an air fuel mixture flowing through it and about its swirler axis, wherein each swirler imparts rotation to the air fuel mixture flowing through it in a direction opposite that of adjacent swirlers. This combustor configuration reduces shear where the outer edges of adjacent flows meet, allowing for greater tuning of the combustion chamber and reduced NOx and CO emissions.

10 Claims, 1 Drawing Sheet

ALTERNATELY SWIRLING MAINS IN LEAN PREMIXED GAS TURBINE COMBUSTORS

FIELD OF THE INVENTION

The present invention relates to dry, low NOx can-annular combustors for gas turbine engines. More specifically, the present invention relates to main swirlers within the combustion can that reduce combustion instabilities, which that permits lower NOx and CO emissions.

BACKGROUND OF THE INVENTION

A combustor of a gas turbine combustion engine often includes several individual combustor cans. Within each can there are multiple swirlers which impart rotational movement to the air-fuel mixture flowing through it. A conventional configuration includes eight main swirlers and a central pilot swirler, where all swirlers have parallel axes. Compressed air flows, into each main swirler individually and into the central pilot swirler individually. Fuel is added to the air as it flows through the swirler, resulting in an air-fuel mixture flowing through each main swirler. Accordingly, in a configuration with eight main swirlers and a central pilot swirler, there are nine air-fuel mixture flows; one through each of the eight main swirlers, and one through the central pilot swirler. Each air-fuel mixture flows axially, centered on the same axis as the swirler through which it is flowing. A swirler then imparts a rotation to this axial flow, such that the air-fuel mixture exiting an individual swirler is flowing along the central axis of that swirler while simultaneously rotating around that central axis. Each of the main swirlers in this relevant configuration imparts a clockwise rotation to the air-fuel mixture flowing through it as viewed looking downstream, and the central pilot swirler imparts a counterclockwise rotation. Consequently, because each main swirler imparts a clockwise rotation to the air-fuel mixture flowing through it, the tangential velocities of the rotation of adjacent air-fuel flows will be opposite where the adjacent air-fuel flows meet. Friction in these areas where adjacent tangential fuel flows oppose each other results in shear and vortices.

The formation of oxides of nitrogen NOx is correlated to the temperature of combustion. Therefore, NOx emissions are reduced by reducing the temperature and size of the hot zones within the combustor. In the combustor configuration described above, the air-fuel flow through the pilot swirler runs relatively rich, i.e. a higher concentration of fuel in this mixture exists than exists in the main swirler flows. This provides a hot central flame to stabilize the overall combustor dynamics, which is necessary because the outer swirlers are unable to stabilize on their own due to the lean air-fuel mixture flowing through them. Thus, reducing NOx emissions in this configuration means reducing the size of the central pilot zone, and/or reducing the temperature of the air-fuel flow in the central pilot zone by reducing the amount of fuel in that air-fuel mixture. However, as the central pilot zone air-fuel flow (and associated temperature) is reduced, combustion dynamics (i.e. pressure oscillations) increase. These dynamic pressure oscillations can be harmful to the combustion chamber.

Dynamic pressure oscillations are associated with either the lean flammability limit of the air-fuel mixture, or fluctuations in the heat release rate of the combustion flame. Oscillations associated with the lean flammability limit are typically characterized by frequencies below 50 hertz. Oscillations associated with combustion flame heat release rate are typically associated with higher frequencies, and they and are often the limiting dynamic in the higher firing-temperature applications currently under development. High frequency pressure oscillations cause fluctuations in the heat release rate of the combustion flame, which is responsive to changes in pressure. A change in the heat release rate of the combustion flame produces pressure oscillations, and the feedback cycle repeats.

As a result, the ability to reduce NOx and CO emissions in the above described combustor configuration is limited by the need to minimize high frequency pressure oscillations. Accordingly, once the temperature of the central pilot zone is reduced to the point where combustion dynamics have reached a maximum safe level, NOx and CO emissions can not be reduced any more.

Conventional swirlers also have variable fuel-hole injection patterns to enable a center rich concentration of fuel in the air fuel mixture. Other patterns known in the art result in air-fuel mixtures where the fuel is either uniformly distributed throughout the air-fuel flow, or is concentrated in the outer portion of the air-fuel flow, result in high levels of combustion driven oscillations. However, because the fuel is concentrated in the center of the air-fuel flow, the peak temperature of the burn at the center of the flow is greater than the temperature of the burn of an evenly distributed air-fuel flow. This center-rich fuel configuration results in greater NOx and CO production, due to the exponential nature of NOx production with temperature.

Further, when main swirler flows have a center rich fuel configuration, complete combustion, which requires complete mixing of the central pilot flow and the main swirler flows, requires more time, resulting in a longer central flame, and yet further increased NOx and CO production.

Thus, there exists a need in the art to further reduce the temperature and/or size of the central pilot zone without increasing combustion dynamics, in an effort to reduce NOx and CO emissions.

BRIEF DESCRIPTION OF THE DRAWINGS

The invention is explained in the following description in view of the drawings that show.

DETAILED DESCRIPTION OF THE INVENTION

The present inventor has recognized that vortices and shear, such as in the areas between main swirlers in the above described configuration, increase the rate in which heat can transfer from the flame, thus exacerbating the heat release/pressure feedback mechanism. The present inventor has also recognized that vortices and shear in the areas between the main swirlers of conventional design contribute to the combustion dynamics that result when fuel is evenly distributed throughout the air fuel flow or when the fuel is concentrated in the outer regions The present inventor has discovered an innovative swirler configuration which will reduce vortices and shear, which will, in turn, reduce NOx and CO emissions. The innovative configuration alternates the direction of swirl in adjacent main swirlers such that every swirler swirls in a direction opposite of adjacent swirlers. For example, in a gas turbine combustion engine containing an even number of main swirlers, and optionally a central pilot swirler, where the main swirlers are positioned around the circumference of the combustion chamber and equidistant from a combustion chamber longitudinal axis, a first, third, fifth and seventh swirler may impart a clockwise swirl to their respective flows, while the second, fourth, sixth, and eighth swirlers may impart a counter-clockwise flow to their respective flows. Embodiments include those with and without central pilot swirlers.

Figure 1:
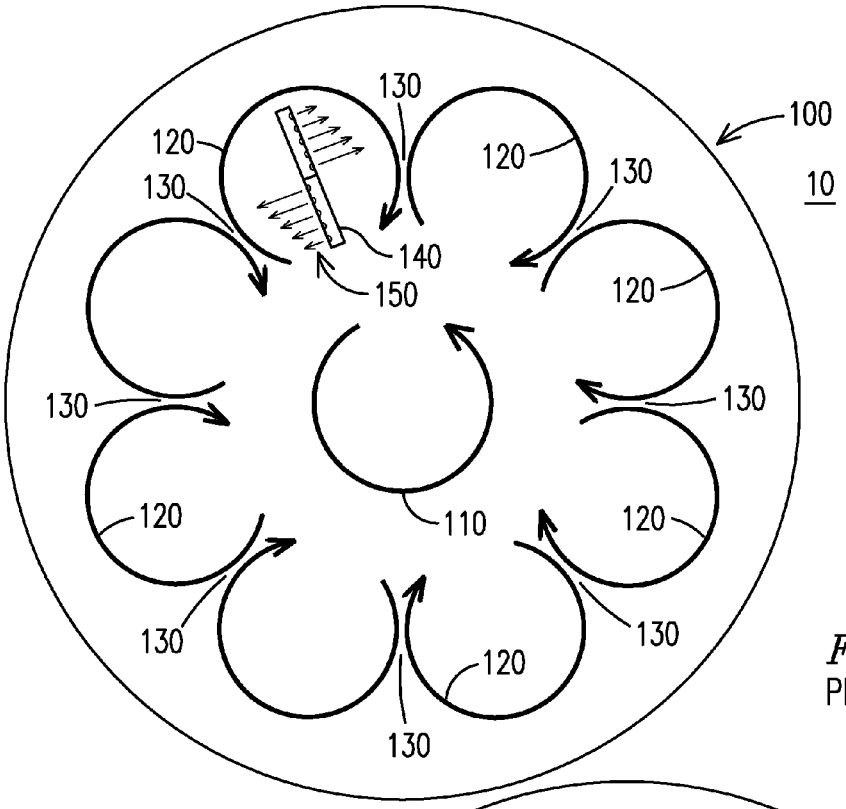
FIG. 1 PRIOR ART
FIG. 1 is a schematic representation of the prior art, where all main swirlers impart clockwise rotation in the air-fuel flow.

FIG. 1 is a schematic representation of a combustor 100 of a gas turbine engine 10 of the prior art, where lines 120 represent the swirlers and the direction of flow each swirler imparts. Areas 130 represent areas of high shear resulting from the friction of the tangential portions of the flows, which oppose each other in that area. Element 140 represents fuel injectors, in the form of plugs, or openings in the swirler blades, or other methods known in the art, for introducing fuel into the air flow. Arrows 150 represent the amount of fuel being introduced into the air flow. In the prior art the concentration of fuel is greater in the center of the flow than in the periphery of the flow, and is represented by arrows of different lengths.

Figure 2:
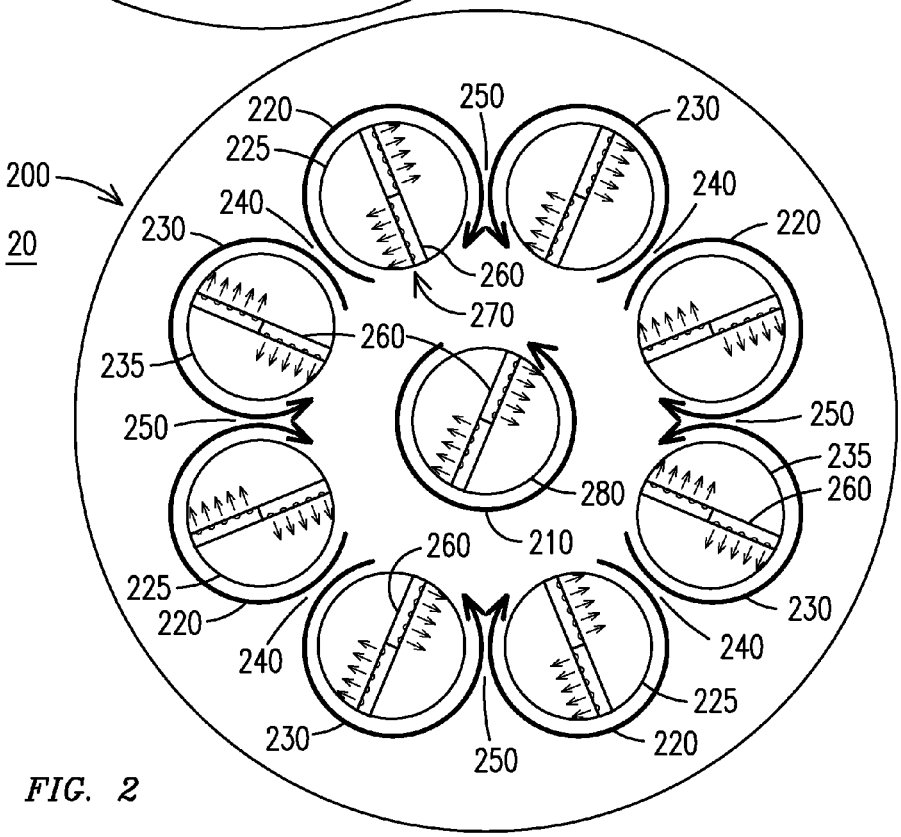
FIG. 2 is a schematic representation of the current invention, where adjacent main swirlers impart opposite rotations to respective air-fuel flows.

As can be seen in FIG. 2, a schematic representation of a gas turbine combustion engine 20 with combustor 200, which, in the case of a can annular combustor is a combustor can, with swirlers 225, 235 and the swirls 220, 230 imparted by the respective swirlers. The Inventor has innovatively modified the configuration of the combustor such that adjacent main swirlers 225, 235 impart an opposite rotation to the air-fuel mixtures that flow through them. Arrows 220 represent the clockwise rotation of the air-fuel flows as they flow along the axes of the certain main swirlers 225 from which they exited. The main swirlers 225 from which flows 220 have exited have retained their original configuration as shown in FIG. 1. Arrows 230 represent the counter-clockwise rotation of the air-fuel flows along the axes of the other main swirlers 235. These swirlers 235 have been reconfigured to impart counter-clockwise flows 230, compared to those of FIG. 1. Each area 240, 250 represents the area where the outer edges of adjacent flows meet. While this schematic uses circular arrows 220, 230 to represent flows, and areas 240, 250 to represent areas where adjacent flows meet, it is understood that these are used for sake of clarity of explanation, and in practice the flows and meeting areas will likely be slightly larger and less defined. Hence, it can be seen that when adjacent main swirlers 225, 235 impart opposite rotations to their respective air-fuel flows, the tangential velocities of the rotation of adjacent air-fuel mixture flows will now be parallel where the adjacent air-fuel mixture flows meet. With parallel flows there is little friction in those areas 240, 250, and hence, shear and vortices are greatly reduced.

Eliminating the shear areas 130 that were present in the prior art allows the present invention to reduce the heat release/pressure feedback mechanism and associated dynamic oscillations, allowing a reduction in the temperature of the central pilot flame, which reduces NOx and CO production when compared to a prior art combustor of FIG. 1 producing the same amount of power. Further, eliminating shear areas 130 permits the use of a more uniform or outer rich distribution of fuel, throughout the air-fuel mixture flowing through each main swirler 225, 235, represented by arrows 270, which allows for a lower peak fuel concentration and thus lower peak burn temperatures in the main swirler flows 220, 230, which also reduces NOx and CO emissions. Even further, a more uniform fuel distribution in the main swirler flows 220, 230 allows for quicker mixing of the central pilot swirler flow 280 with the main swirler flows 220, 230, which results in more rapid complete combustion in the central pilot flame produced by a central pilot burner 215 which, in turn, provides a shorter central pilot flame, again further decreasing NOx and CO production. Fuel may be delivered via fuel injectors 260 in the form of pegs, or openings in the swirler blades, or other methods known in the art, for introducing fuel into the air flow.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A can annular gas turbine combustor for producing hot gas by burning a fuel in compressed air comprising:

a combustor central axis, a plurality of main swirlers with respective swirler axes disposed about, equidistant from, and parallel to the combustor central axis, each main swirler configured to deliver an air fuel mixture flowing therethrough about the respective swirler axis, wherein airfoils of a first of two adjacent swirlers are concentric with and angled in a first direction about a first swirler axis and airfoils of a second swirler axis such that during operation tangential components of flow direction of meeting portions of adjacent air fuel mixtures travel in the same direction;

fuel injectors for distributing fuel within each main swirler air fuel mixture in a concentration other than a center rich concentration; and a central pilot swirler disposed on the central axis and delivering a pilot air fuel mixture flowing therethrough.

2. The gas turbine combustor of claim 1, comprising an even number of main swirlers.

3. A gas turbine combustion engine comprising the combustor of claim 1.

4. A combustor can for a can annular gas turbine combustion engine having a combustor central axis and a plurality of main swirlers with respective swirler axes disposed about, equidistant from, and parallel to the combustor central axis, each main swirler delivering an air fuel mixture flowing therethrough about the respective swirler axis, the improvement comprising:

a configuration of alternating clockwise and counter-clockwise swirlers, wherein each swirler is configured to impart rotation to the air fuel mixture flowing therethrough in a direction opposite that of adjacent swirlers; and fuel injectors operable to distribute a fuel within each air fuel mixture in a concentration other than center rich.

5. The combustor can of claim 4, further comprising an even number of main swirlers.

6. A gas turbine combustion engine comprising the combustor can of claim 4.

7. The combustor can of claim 4, further comprising a central pilot swirler disposed on the central axis and delivering a pilot air fuel mixture flowing therethrough.

8. A mixing arrangement for a combustor can for a can annular gas turbine engine, each can comprising: a plurality of clockwise main swirlers interposed among a plurality of counterclockwise main swirlers, wherein all swirlers are located equidistant from a central axis and each swirler is configured to deliver an air fuel mixture flowing therethrough about a respective swirler axis in a concentration within each air fuel mixture other than a center rich concentration; and a central pilot swirler disposed on the central axis and configured to deliver a pilot air fuel mixture flowing therethrough.

9. A gas turbine combustion engine comprising the mixing arrangement of claim 8.

10. The mixing arrangement of claim 8 comprising an even number of main swirlers.

* * * * *